US009643830B2

(12) United States Patent
Kuhn et al.

(10) Patent No.: US 9,643,830 B2
(45) Date of Patent: May 9, 2017

(54) KEG CLOSURE WITH VENTING MECHANISM

(71) Applicant: PETAINER LARGE CONTAINER IP LIMITED, Peterborough (GB)

(72) Inventors: Vilem Kuhn, As (CZ); Stanislav Churý, Cheb (CZ); Peter Ford, Leicester (GB); Lee Cottrell, Leicester (GB)

(73) Assignee: Petainer Large Container IP Limited, London (GB)

( * ) Notice: Subject to any disclaimer, the term of this patent is extended or adjusted under 35 U.S.C. 154(b) by 0 days.

(21) Appl. No.: 14/646,932

(22) PCT Filed: Nov. 22, 2013

(86) PCT No.: PCT/GB2013/053093
§ 371 (c)(1),
(2) Date: May 22, 2015

(87) PCT Pub. No.: WO2014/080219
PCT Pub. Date: May 30, 2014

(65) Prior Publication Data

US 2015/0274502 A1 Oct. 1, 2015

(30) Foreign Application Priority Data

Nov. 23, 2012 (GB) ..... 1221141.3

(51) Int. Cl.
*B67D 1/08* (2006.01)

(52) U.S. Cl.
CPC ..... *B67D 1/0829* (2013.01); *B67D 1/0831* (2013.01); *B67D 1/0845* (2013.01)

(58) Field of Classification Search
CPC ... B67D 1/0829; B67D 1/0831; B67D 1/0845
(Continued)

(56) References Cited

U.S. PATENT DOCUMENTS 3,217,947 A * 11/1965 Bauerlein ..... B67D 1/1252 222/397
3,880,187 A * 4/1975 Kneusel ..... B65D 83/70 137/843

(Continued)

FOREIGN PATENT DOCUMENTS

EP 2505546 A1 10/2012
GB 789729 1/1958

(Continued)

OTHER PUBLICATIONS

European Examination Report pertaining to Application No. 13 815 548.6 dated Oct. 17, 2016.

*Primary Examiner* — Donnell Long
(74) *Attorney, Agent, or Firm* — Dinsmore & Shohl LLP

(57) ABSTRACT

A closure (10) for use with a beverage keg (20) is disclosed. The closure (10) comprises an inlet, a barrier (1) and a housing (2) that defines a venting hole (11). The barrier (1) seals the venting hole (11). The closure (10) comprises an unvented configuration in which a keg to which the closure is fitted can be pressurized. The closure (10) also comprises a vented configuration in which the barrier (1) is unsealed from the venting hole (11) to permit depressurization of the keg (20).

21 Claims, 9 Drawing Sheets

(58) Field of Classification Search
USPC ..... 222/397, 399, 400.7, 481.5, 479, 81–83, 222/89, 90, 153.14; 220/203.08, 268, 220/89.1, 89.2; 137/212, 511; 53/476
See application file for complete search history.

(56) References Cited

U.S. PATENT DOCUMENTS 4,446,984 A * 5/1984 Roth ..... B65D 51/1683 220/203.04
4,446,990 A * 5/1984 Stevenson ..... F41H 9/10 222/398
5,526,956 A * 6/1996 Osgar ..... B65D 85/84 222/105
6,089,415 A * 7/2000 Terpstra ..... B67D 1/0838 137/212
6,241,116 B1 * 6/2001 Schrepfer ..... B65D 7/42 220/581
6,311,875 B1 * 11/2001 Anderson ..... B67D 1/0832 222/396
7,703,640 B1 * 4/2010 Hollars ..... F16K 17/383 169/57
2007/0284371 A1 * 12/2007 Anderson ..... B65D 7/045 220/4.12
2009/0283553 A1 * 11/2009 Hoss ..... B67D 1/0418 222/396
2010/0019000 A1 * 1/2010 Kraus ..... B65D 83/70 222/397
2010/0102087 A1 * 4/2010 Meike ..... B67D 1/0462 222/105
2010/0294762 A1 * 11/2010 Kolon ..... C08L 95/00 220/89.1
2011/0280502 A1 * 11/2011 Meike ..... B67O 1/0829 383/42
2012/0248109 A1 * 10/2012 Fuchs ..... B67O 1/0831 220/203.08

FOREIGN PATENT DOCUMENTS

GB 2479467 A 10/2011
WO 02/30808 A1 4/2002
WO 2007-064277 6/2007

* cited by examiner

KEG CLOSURE WITH VENTING MECHANISM

This invention relates to pressurised vessels such as kegs for storing, transporting and dispensing beverages. The invention also relates particularly to a closure for a keg, the closure having a safety mechanism to enable a keg to which the closure is fitted to be vented after use. This ensures that the keg cannot be left pressurised after use and also that it cannot be refilled with the closure being re-closed afterwards.

Kegs are widely used for the distribution and service of beverages such as beer. A keg closure typically includes a valve that defines multiple flow paths through the closure. Each flow path either leads to either a headspace of the keg (adjacent to the closure and neck of the keg), or leads to an internal base region of the keg via a dip-tube.

During filling, beverage is usually injected into the keg through the closure via a first flow path while displaced gas can exit the keg through the closure via a second flow path. Conversely, during dispensing, a propellant inert gas (typically nitrogen or carbon dioxide) can be injected into the keg through the closure via the first flow path to force beverage out of the keg through the closure along the second flow path. In the most common 'well-type' and 'flat type' arrangements, the closure comprises one or more valve elements and concentric flow paths.

At a filling station on a production line, the keg is usually inverted when filling the keg with beer and carbonated soft drinks, although it could be upright for other beverages, especially those without effervescence, and a filling head is coupled to the closure to form a seal with the closure. The filling head has one or more formations that press against one or more spring-loaded valve elements of the closure to open the flow paths through the closure. Air inside the keg is flushed out with a relatively inert gas, for example carbon dioxide, and beverage is then injected into the keg via a liquid line connected to the filling head. Gas displaced from the keg by the incoming beverage is forced out through an outlet in the filling head. When the keg is removed from the filling station, the filling head is uncoupled from the closure and the one or more valve elements of the closure therefore snap shut under spring loading, sealing the beverage and any remaining inert gas within the keg.

For the purpose of dispensing the beverage, a dispense head is coupled to the closure to form a seal with the closure. The dispense head has a lever that, when depressed, extends one or more plungers corresponding to the formations of the filling head. The plunger(s) therefore press against one or more valve elements of the closure to re-open the flow paths through the closure. Those flow paths communicate with gas and liquid lines connected to the dispense head. A propellant gas is injected into the keg from an external source connected to the gas line. Beverage is then forced out of the keg when a tap in the liquid line is opened to dispense the beverage.

When the dispense head is coupled to the closure, the propellant gas is injected into the keg at super-atmospheric pressure. The keg will remain under super-atmospheric pressure unless and until that gas is vented. It is recommended for safety purposes to vent the propellant gas from the keg prior to the dispense head being uncoupled from the closure, typically when the keg has been emptied and is being interchanged with a fresh, full keg. Such venting may be achieved by first disconnecting the pressure line from the dispense head before removing the dispense head from the closure. However, in practice, a user will often be in a hurry to swap empty kegs for full kegs while dispensing beverages in a busy bar and may not therefore take the time necessary to vent the propellant gas from the empty keg.

Instead, the user may simply remove the dispense head from the closure, allowing the one or more spring-loaded valve elements of the closure to snap shut and hence to close the flow paths through the closure. The result is that the empty keg remains pressurised, which may not be apparent upon viewing the keg. This is a particular problem where a keg is of flexible material such as blow-moulded polyethylene terephthalate (PET), which is intended to allow the keg to be crushed after use for recycling rather than being returned intact for refilling like a rigid metal keg. Clearly a pressurised keg is not easily crushable. Also, in safety terms, it is undesirable for a pressurised keg to be punctured or ruptured, for example if an attempt is made to crush the keg during waste disposal while believing that the keg is not pressurised.

Another problem is that if the valve element(s) of the closure can still be opened and closed after the original beverage has been dispensed, the keg could possibly be re-filled in an unauthorised manner. For example, the keg could be re-filled with a beverage that is not of the appropriate quality; certainly, the keg is unlikely to be re-filled under the controlled conditions necessary to deliver a beverage in optimum condition. This is particularly undesirable as the keg may bear the brand of the original beverage supplier, whose reputation may be damaged by apparently supplying an inferior product. The keg could even be re-filled with a liquid that is not intended for human consumption and that could be dangerous to drink. Unauthorised refilling may not be apparent from a cursory inspection of the keg.

It is against this background that the present invention has been devised.

According to a first aspect of the present invention there is provided a closure for a pressurised vessel such as a beverage keg. For the avoidance of doubt, whilst the first aspect of the invention relates to a closure in isolation, it will be understood that in other aspects, the invention may extend to a closure in combination with a pressure vessel such as a beverage keg.

The closure comprises a housing which defines an inlet and a venting hole. The closure ideally also comprises a barrier for sealing the venting hole. The closure may be switchable between an unvented configuration and a vented configuration. Ideally, the closure is manually switchable between the unvented and vented configurations. Preferably, in the unvented configuration, the barrier seals the venting hole. Ideally, in the vented configuration, the barrier no longer seals the venting hole. Thus, in the unvented configuration, a keg to which the closure is fitted can be pressurised and in the vented configuration, that keg can be depressurised. Advantageously, the venting hole and the barrier together provide a simple way in which a keg can be permanently depressurised. Thus, the closure is effectively provided with a safety mechanism that enables a keg to which the closure is fitted to be vented after use. This ensures that the keg cannot be left pressurised after use and also that it cannot be refilled with the closure being re-closed afterwards.

Ideally, the closure is arranged to be fitted to beverage keg. Ideally, when the closure is fitted to a beverage keg, it is switchable irreversibly from the unvented configuration to the vented configuration. Accordingly, the keg to which the closure is fitted can be permanently depressurised. Advantageously, this prevents re-pressurisation of the beverage keg whilst the closure is fitted to the keg. If the closure is unfitted from the beverage keg, then it may then be notionally possible to switch the closure back from the vented to the unvented configuration, however, doing so may require disassembly of the closure, or render tamper-evidencing damage to the closure and/or keg.

Ideally, the venting hole communicates with a gas vent path between the headspace of the keg and an exterior of the closure. The venting hole is advantageously separate from the inlet so that the keg can be depressurised regardless of the state of the inlet. For example, if the inlet is closed, this does not hinder depressurisation of the keg. Accordingly, the keg to which the closure is fitted can be permanently depressurised, and so thereafter be easily and safely handled, for example crushed for disposal or recycling. Furthermore, the permanent depressurisation prevents unauthorised refilling, pressurisation and reuse of the keg.

Ideally, the closure is intended for use with a keg suitable for the pressurised dispensing of draught beverages such as beer. Ideally, the inlet is for admitting a pressurised propellant gas into the keg for the pressurised dispensing of draught beverages from the keg. Accordingly, the closure may define a gas flow path between the inlet and an internal headspace of the keg to which the closure is fitted. The gas flow path and the gas vent path may join with one another at least in part.

Ideally, the housing of the closure is shaped and arranged to allow fitment of the closure to the keg. Ideally, the closure is arranged to engage with and seal around a neck of the keg. Ideally, the housing of the closure is arranged so that the closure can be at least partly received within the neck of the keg. This has many advantages including saving space, and improving the strength of the engagement between the keg and closure. Ideally, to facilitate automated fitting of the closure to the keg, the closure can be push-fit on to the keg.

As mentioned, the housing may define the venting hole. More specifically, the housing may comprise a wall within which the venting hole may be defined. Preferably, the barrier is engaged to the housing defining the venting hole when the closure is in the unvented configuration. Ideally, the barrier is arranged to be dislodged from its engagement with the housing so as to switch the closure to the vented configuration. Preferably, the barrier is fitted at least partly within the venting hole to seal the closure in the unvented configuration. Ideally, the barrier is arranged to be expelled from the venting hole so as to switch the closure to the vented configuration. Ideally, the barrier is a discrete member such as a bung which, when dislodged, separates from the housing defining the venting hole. Advantageously, the dislodging of the barrier from its engagement with the housing defining the venting hole further assures the permanency of the depressurisation.

Preferably, the closure further comprises a retention portion for retaining the barrier to the closure when the closure is in the vented configuration, and the barrier is unsealed/dislodged from the venting hole. The retention portion may comprise a cage within which the barrier is captured if the barrier is fully separated from the housing defining the venting hole. Ideally, the gas vent path is at least partly routed through the cage. Advantageously, the retention portion allows the barrier to become disengaged from the housing defining the venting hole, but prevents separation of the barrier from the closure in general. If the barrier were to be completely separated from the wall defining the venting hole, then there would be a danger that the barrier could fall into a beverage contained within the keg, potentially spoiling it. The retention portion prevents this.

Ideally, at least one of the barrier and housing defining the venting hole are shaped to restrain the barrier against movement in an outward direction towards the exterior of the closure. Preferably, the barrier and wall defining the venting hole are tapered relative to one another so as to ensure a reliable seal between the barrier and the venting hole and also to restrain the barrier against movement in the outward direction toward the exterior of the closure. Advantageously, this further assures the permanency of the depressurisation of the keg. Effectively, this is because the barrier must be dislodged from the venting hole by moving it in a direction toward the interior of the closure or keg. When the closure is fitted to the keg, this is at a position that is practically inaccessible to a user, and so the user cannot reattach the barrier to reseal the venting hole. Furthermore, in this configuration, a force on the barrier imparted by a super-atmospheric pressure within the keg cannot force the barrier in a direction that unseals the venting hole, causing premature depressurisation.

The closure may comprise a venting member. Alternatively, the closure may simply be arranged or configured for operation or interaction with a venting member, the venting member not necessarily being part of the closure.

Ideally, the venting member is arranged to act on the barrier to unseal the barrier from the venting hole thereby to switch the closure from the unvented to the vented configuration. Advantageously, the venting member can be optimally shaped and arranged to effectively transfer a force provided by a user wishing to depressurise the keg to the barrier. To this end, the venting member may comprise a drive member for transmitting a manually-applied force to the barrier.

Advantageously, the manually-operable drive member provides a greater choice in the design, size and shape of the barrier. Specifically, the barrier can be chosen to be small in size relative to the rest of the closure. This can minimise the outward force acting on the barrier when the keg is pressurised, and so can make it easier for a user to drive the barrier into the closure against the gas pressure. If the drive member were not present, then the barrier would need to be of a minimum size and shape to allow, for example, a user's finger to unplug it from the venting hole by pushing the barrier in towards the closure. Furthermore, the drive member can allow a user to apply the force necessary to unseal the barrier more comfortably; the force applied by the user's fingers or hand can be spread over a relatively large area, yet can be transmitted via the drive member to a barrier having a comparatively smaller area. To this end, the venting member may comprise a hand contact region for receiving a manually-applied force, that hand contact region being larger than a barrier contact region for transmitting that manually-applied force to the barrier.

Ideally, at least a portion of the venting member is arranged to fit within the venting hole. Advantageously, this allows the venting member to be in direct contact with the barrier, and at position ready for depressurising a keg to which the closure is fitted. Ideally, the portion of the venting member that is arranged to fit within the venting hole defines a conduit shaped and arranged to permit gas released during depressurisation of the keg to flow through the venting hole whilst that portion of the venting member is in the venting hole. Advantageously, this further ensures the safety of the closure during depressurisation as the vented gas can be routed by the conduit in a way that prevents injury to a user. Ideally, the venting member is arranged to drive the barrier in an inward direction away from the exterior of the closure, and in towards the gas vent path. This can further minimise injury as there is no danger of the barrier being forcibly expelled towards the user by the vented gas.

Another advantage of the venting member is that it prevents tampering with the depressurisation function of the closure. As the venting member drives the barrier through the venting hole, the venting hole and the barrier are not necessarily directly accessible to a user. Thus the venting hole cannot easily be accessed for unauthorised resealing of the keg after depressurisation.

Ideally, the closure is switched from the unvented to the vented configuration via movement of the venting member between a respective first and second position. Advantageously, this provides a visual indication to a user that the keg has been depressurised, and so can be safely disposed. Ideally, the movement of the venting member is a sliding movement relative to the housing of the closure. Preferably, the housing defines a channel along which the venting member is slidable.

Ideally, the closure further comprises at least one latch member. Ideally, the at least one latch member is arranged to be movable between a latched position and an unlatched position. At the latched position, the at least one latch member may block movement of the venting member preventing the venting member from acting on the barrier. Ideally, at the unlatched position, the at least one latch member no longer blocks the movement of the venting member. Accordingly, at the unlatched position, the venting member is free to move to a position at which the venting member can act on the barrier to unseal the venting hole. Ideally, the at least one latch member is biased towards the latched position. Advantageously, the latch member can prevent accidental depressurisation.

Ideally, the at least one latch member is moveable towards the unlatched position in a direction transverse to the direction in which the venting member moves to act on the barrier to unseal the venting hole. This can further guard against accidental depressurisation of a keg to which the closure may be fitted. This is because it is very difficult for a user to accidentally apply forces in the two different directions: one to unlatch the latch member, and the other to move the venting member to unseal the venting hole.

Nonetheless, it is preferred that the at least one latch member and the venting member are positioned and arranged relative to one another to permit one-handed operation of the closure to switch it from the unvented to the vented configuration. Ideally, such one-handed operation does not require a user's hand to shift position when switching the closure from the unvented to the vented configuration. Advantageously, this arrangement increases the ease with which a user can intentionally depressurise the keg to which the closure is fitted.

Ideally, the at least one latch member is integrally-formed with the venting member. This can reduce the cost of the closure.

Ideally, the closure comprises at least one ratchet formation that locks the venting member at a position at which the venting member has acted on the barrier to unseal it from the venting hole. This can prevent reverse movement of the venting member to a position which may otherwise incorrectly indicate to a user that the keg to which the closure may be fitted that said keg is not depressurised. A further advantage of a ratchet formation is that when it ratchets into place, it provides a tactile and audible cue that the closure has been successfully switched to the vented configuration.

Ideally, the at least one ratchet formation is integrally-formed with the venting member. Again, this can reduce the cost of the closure.

The closure may comprise a valve element for opening and closing the inlet. The valve element may be biased towards a closed position. The closure may further comprise an outlet through which a liquid such as a beverage may be extracted from the keg to which the closure is fitted. The valve element may be for opening and closing the outlet of the closure. The inlet and the outlet of the closure may be arranged concentrically to one another. Ideally, the outlet is at a radially-inner position relative to the inlet. This arrangement can make it easier to introduce a pressurising gas into the headspace of the keg via the inlet, and as a result to extract a liquid such as a beverage from the keg via the outlet. This is because a fluid-extraction structure such as a dip-tube can be more easily fit to the concentrically-inner outlet.

The closure may further comprise a dip-tube. The dip-tube may be positioned so that when the closure is fitted to a keg, an open end of the dip-tube is positioned adjacent to a lowermost position within the keg. This is to ensure that substantially all the liquid within the keg can be extracted via the dip-tube. Accordingly, the closure may define a fluid flow path that extends between the outlet and a lowermost position of the keg, ideally an internal base region of the keg. In this scenario, it is assumed that the keg is stood upright on its base.

Ideally, the closure, when in the unvented configuration, is arranged to receive a pressurised gas via the inlet to dispense beverage from a keg to which the closure is fitted via the outlet.

Ideally, the closure, and/or one or more valve elements are shaped and arranged to receive a standard filling or dispensing head so as to allow filling or dispensing of beverage from a keg to which the closure is fitted using standard equipment.

According to a second aspect of the present invention there is provided a pressure vessel, such as a beverage keg, supplied or fitted with a closure according to the first aspect of the present invention. Ideally, the vessel is constructed from a flexible material. The material may be a plastics material. The vessel may be blow-moulded from polyethylene terephthalate (PET). Where the pressure vessel is a keg, the keg is ideally suitable for storing, transporting and dispensing beverages.

According to a third aspect of the present invention there is provided a method of controlling the pressurisation a vessel such as a beverage keg. A method may comprise fitting a closure to the vessel. The closure may define a venting hole communicating with a gas vent path between a headspace of the vessel and an exterior of the closure. The closure may be provided with a barrier to seal the venting hole so as to retain a pressurised gas within the vessel. The method may further comprise unsealing the barrier from the venting hole to permanently depressurise the vessel. The vessel may accord to the second aspect of the present invention. The closure may accord to the first aspect of the present invention.

According to a fourth aspect of the present invention there is provided a method of improving the safety of a vessel such as a draught beverage keg. The method may comprise at least one of the steps of:

- fitting a closure to the vessel, the closure being in an unvented configuration in which it is able to retain a pressurised gas within the vessel;
- filling the vessel with a liquid such as a beverage to be dispensed on draught;
- transporting the filled vessel to a dispensing location;

injecting a pressured gas into the vessel to dispense liquid (such as draught beverage) from it; and after dispensing of liquid:

permanently depressurising the vessel by switching the closure from the unvented configuration to a vented configuration.

The vessel may accord to the second aspect of the present invention. The closure may accord to the first aspect of the present invention.

It will be understood that features or advantages of the different aspects of the present invention may be combined or substituted where context allows.

In order that the invention may be more readily understood, reference will now be made, by way of example, to the accompanying drawings in which.

Figure 1:
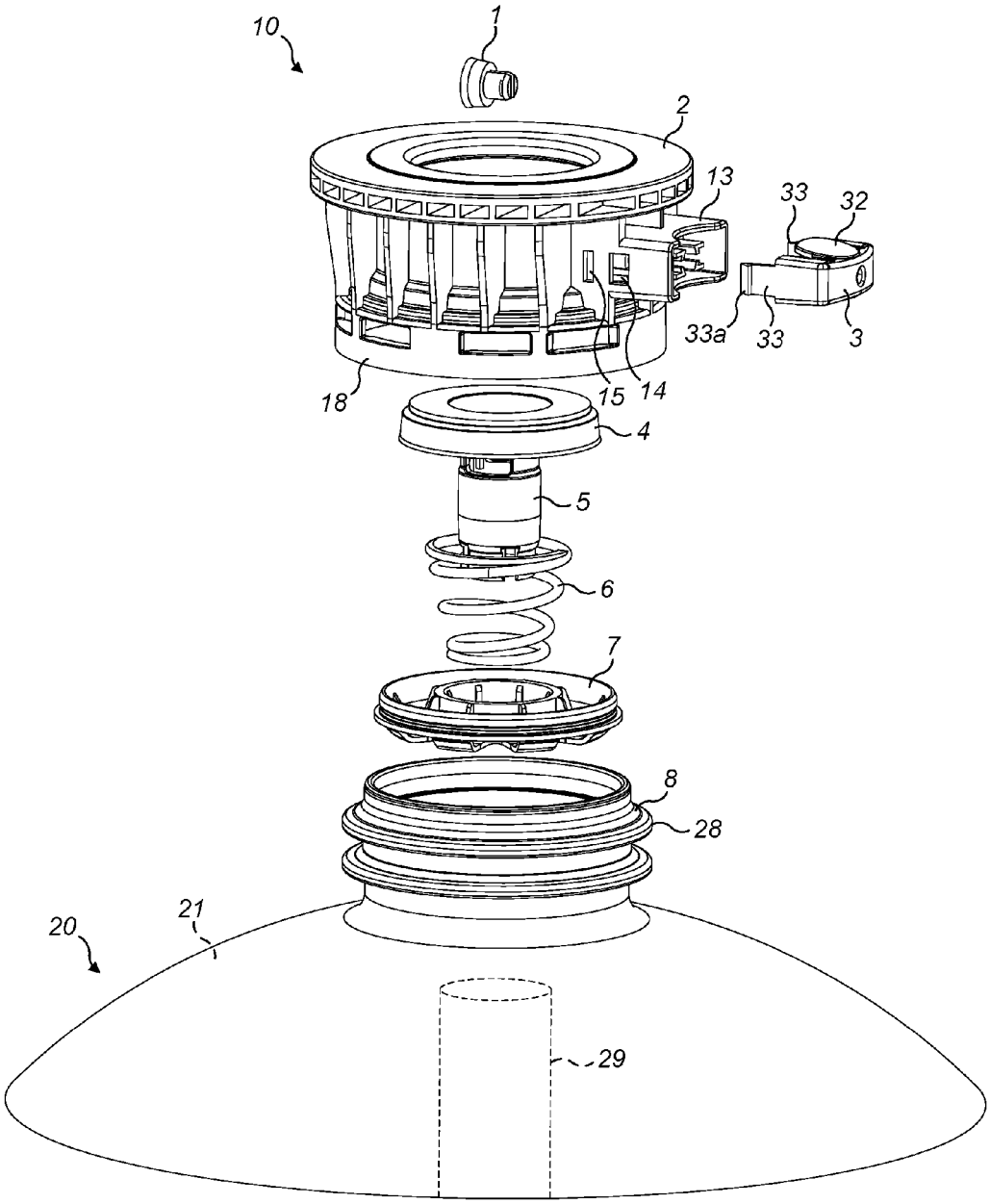
FIG. 1 is a perspective exploded view of a closure according to a first embodiment of the present invention, to be fitted to the neck of a plastics keg.
Figure 4:
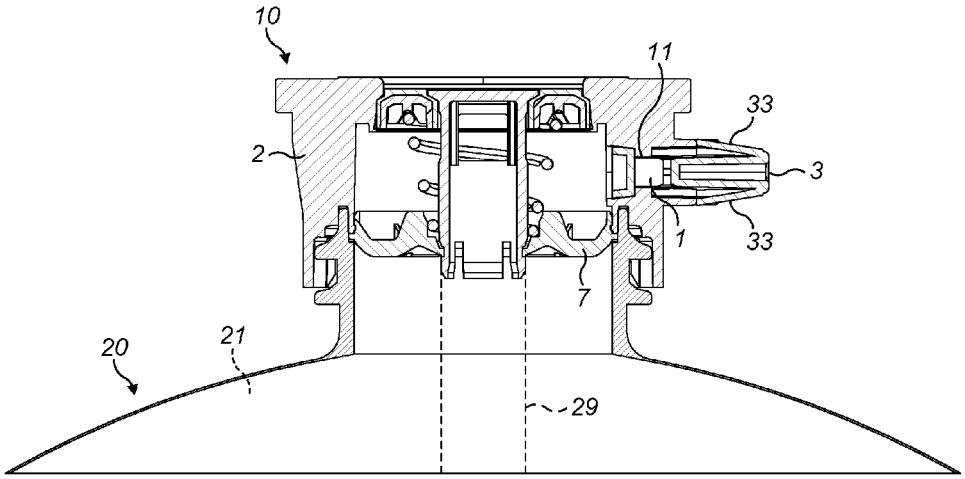
FIG. 4 is a cross-sectional view of the keg and closure of FIG. 3, the cross-section being taken along section plane A-A that bisects the keg and closure and intersects a central longitudinal axis shared by the keg and closure.
Figure 5:
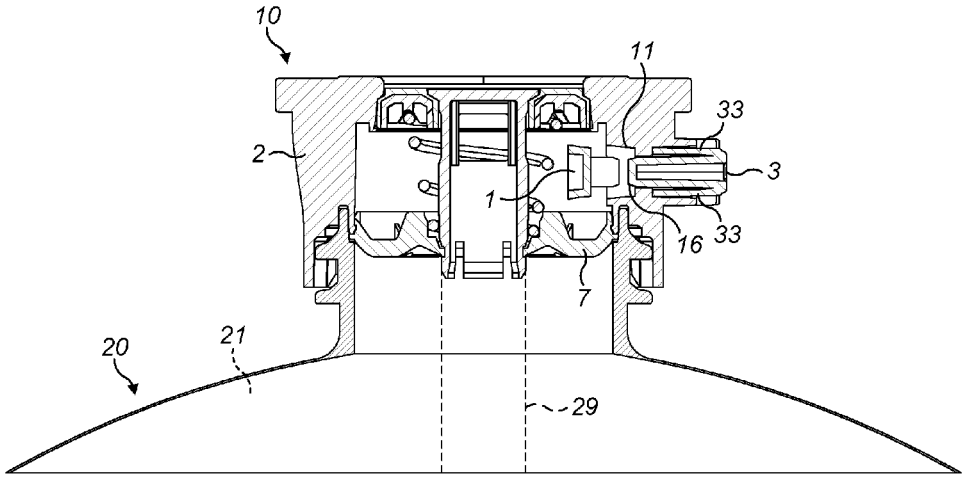
Figure 6:
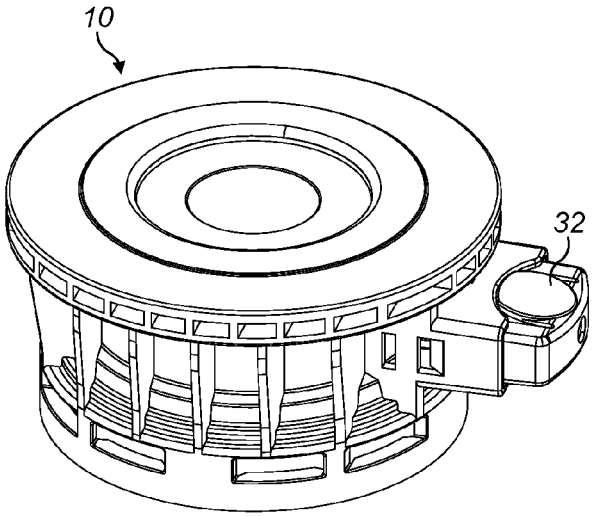
Figure 7:
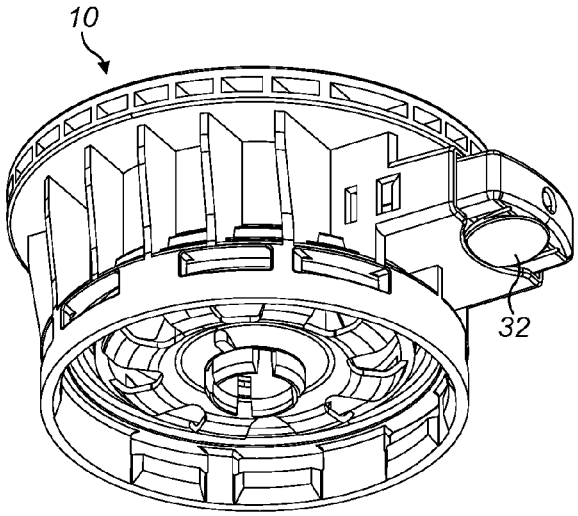
Figure 8:
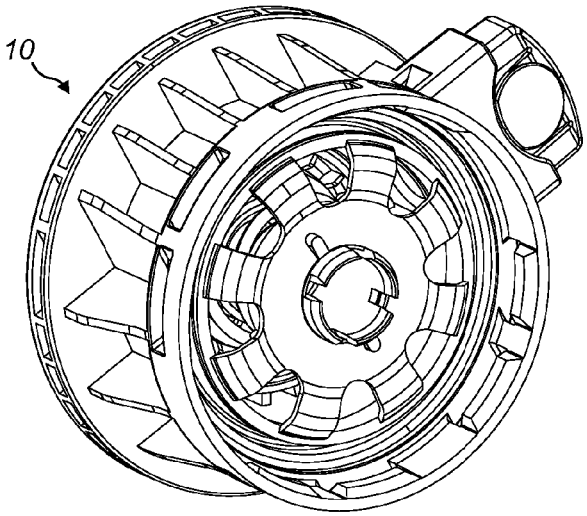
Figure 9:
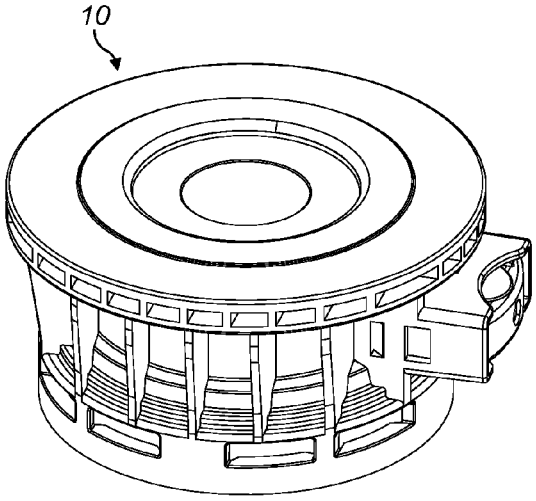
Figure 10:
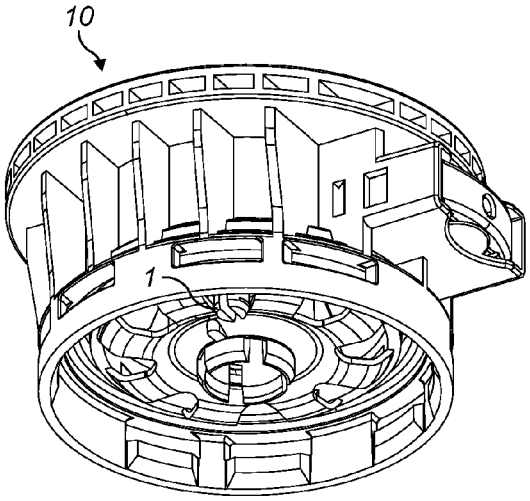
Figure 11:
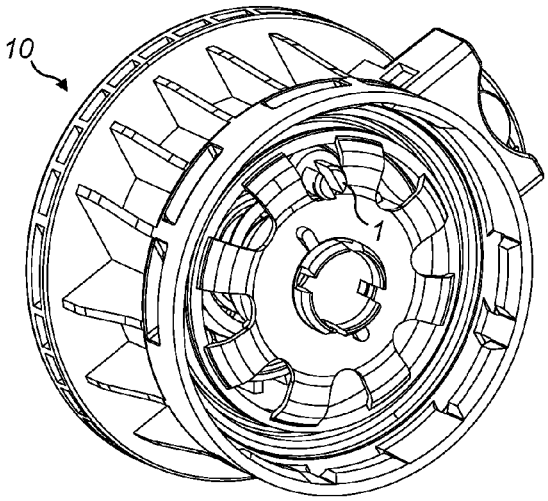
Figure 11A:
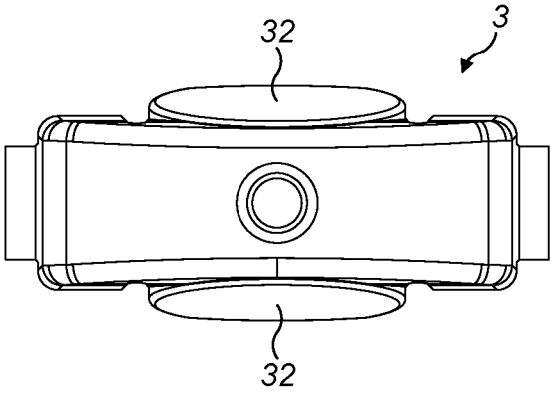

FIG. 5 corresponds to FIG. 4 but shows the closure in a vented configuration;

FIG. 6 is a perspective view from above and one side of the closure of FIG. 1, the closure being shown here in isolation from a keg, with the closure being in an unvented configuration;

FIG. 7 is a perspective view from below and one side of the closure of FIG. 6;

FIG. 8 is a further perspective view from below the closure of FIG. 6;

FIGS. 9 to 11 correspond to FIGS. 6 to 8 respectively but show the closure when in a vented configuration;

FIG. 11*a* shows a front perspective view of a push button of the closure of FIG. 1, the push button being shown in isolation from the closure.

Figure 11B:
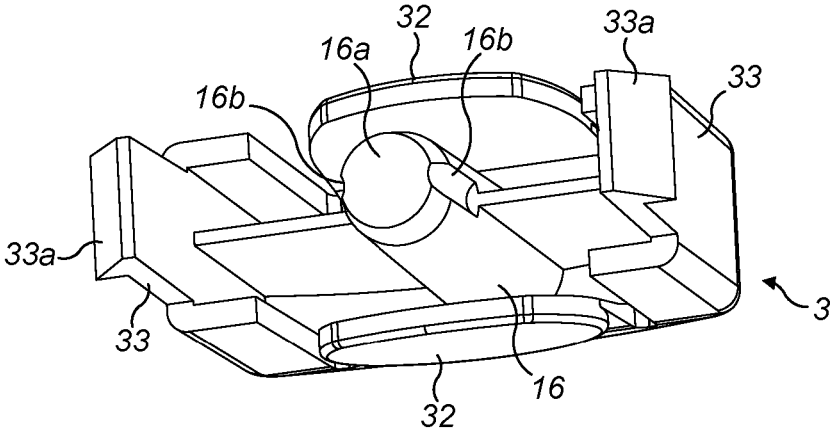

FIG. 11*b* shows a reverse perspective view of the push button of FIG. 11*a*.

Figure 12:
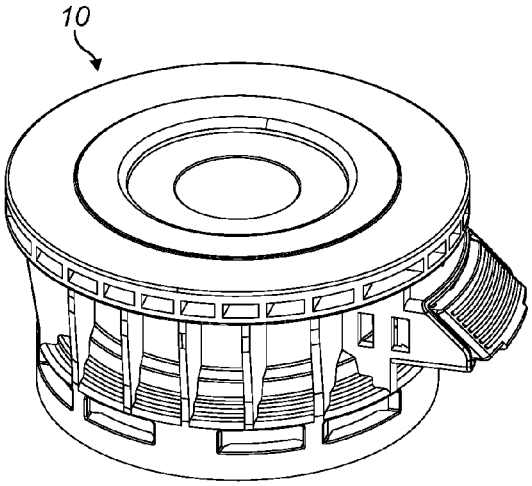
Figure 13:
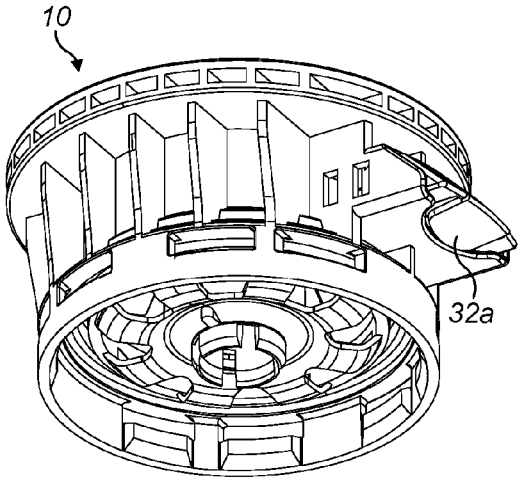
Figure 14:
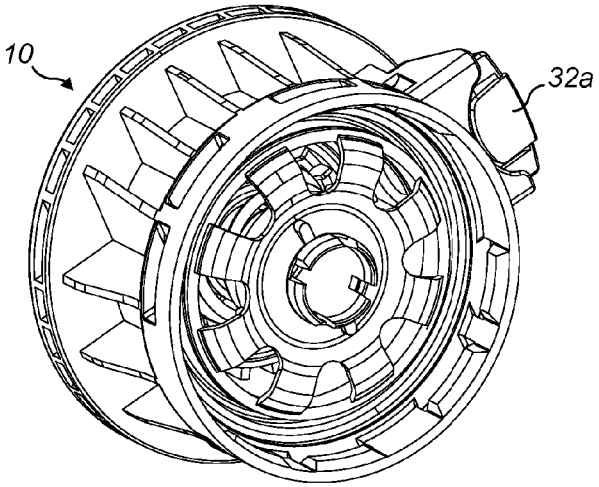
Figure 15:
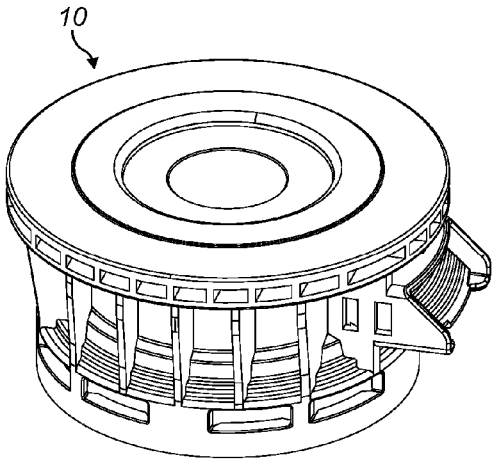
Figure 16:
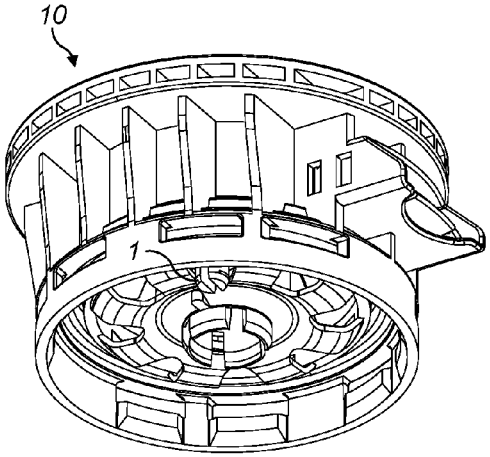
Figure 17:
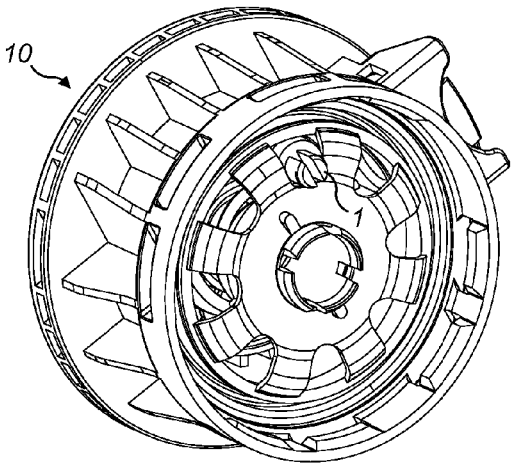

FIG. 12 is a perspective view from above and one side of a closure according to a second embodiment of the present invention, the closure again being shown in isolation from a keg, with the closure being in an unvented configuration;

FIG. 13 is a perspective view from below and one side of the closure of FIG. 12;

FIG. 14 is a further perspective view from below the closure of FIG. 12;

FIGS. 15 to 17 correspond to FIGS. 12 to 14 respectively but show the closure when in a vented configuration.

Figure 17A:
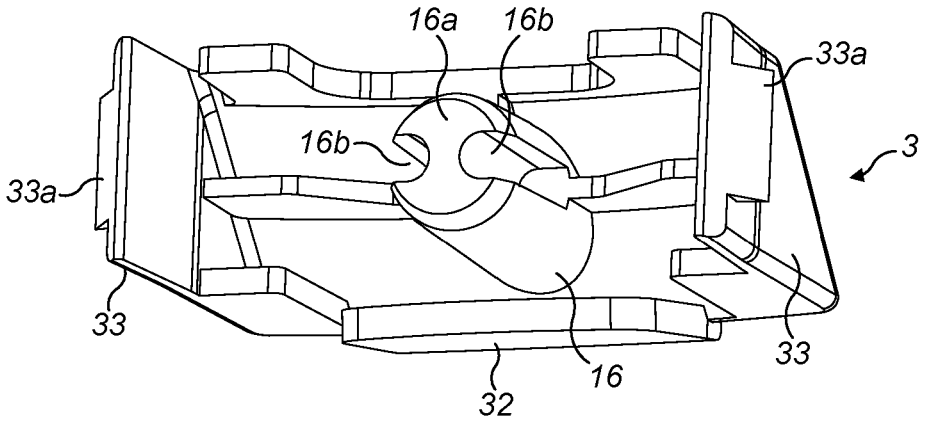

FIG. 17*a* shows a reverse perspective view of the closure of FIG. 12, the push button being shown in isolation from the closure.

The embodiments of the present invention relate to a keg closure corresponding functionally and in key dimensions with existing keg closures known in the art as 'Flat Type', 'Type A' or 'Flat Type A' keg closures. As such, standard dispensing or filling heads suitable for use with such 'Flat Type A' keg closures can also be used in conjunction with the closure of the first and second embodiments of the present invention.

FIGS. 1 to 11*b* relate to the first embodiment of the present invention and FIGS. 12 to 17*a* relate to the second embodiment of the present invention. The same reference numerals are used to refer to similar features in these embodiments. In particular, each show a closure 10 adapted to be push-fitted to the neck 8 of a keg 20, the closure 10 having components that allow the keg 20 to be vented after use for safe disposal of the keg 20, the vented state of the keg being clearly indicated by the closure 10.

The components of each closure 10 are made predominantly of injection-moulded plastics materials such as polyester, polyolefin, polyamide or the like. The keg is formed from PET, stretch blow-moulded from a preform. It is emphasised that the materials used for the keg 20 and the closure 10 and their methods of manufacture are merely preferred and are not essential to the broad inventive concept.

Figure 2:
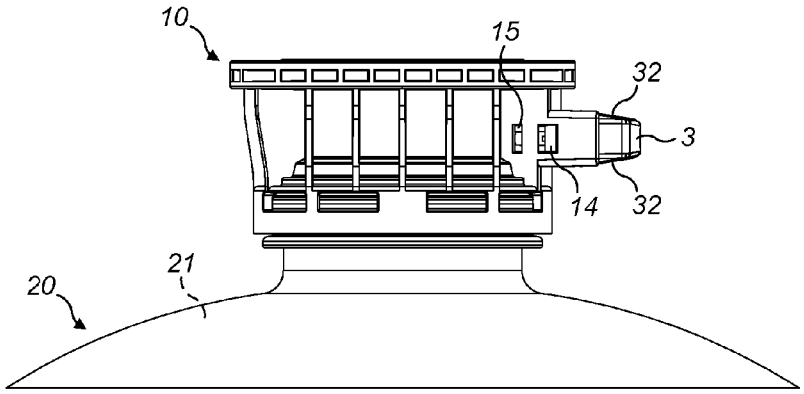
FIG. 2 is a side view of the closure of FIG. 1 fitted to the keg, the closure being in an unvented configuration.
Figure 3:
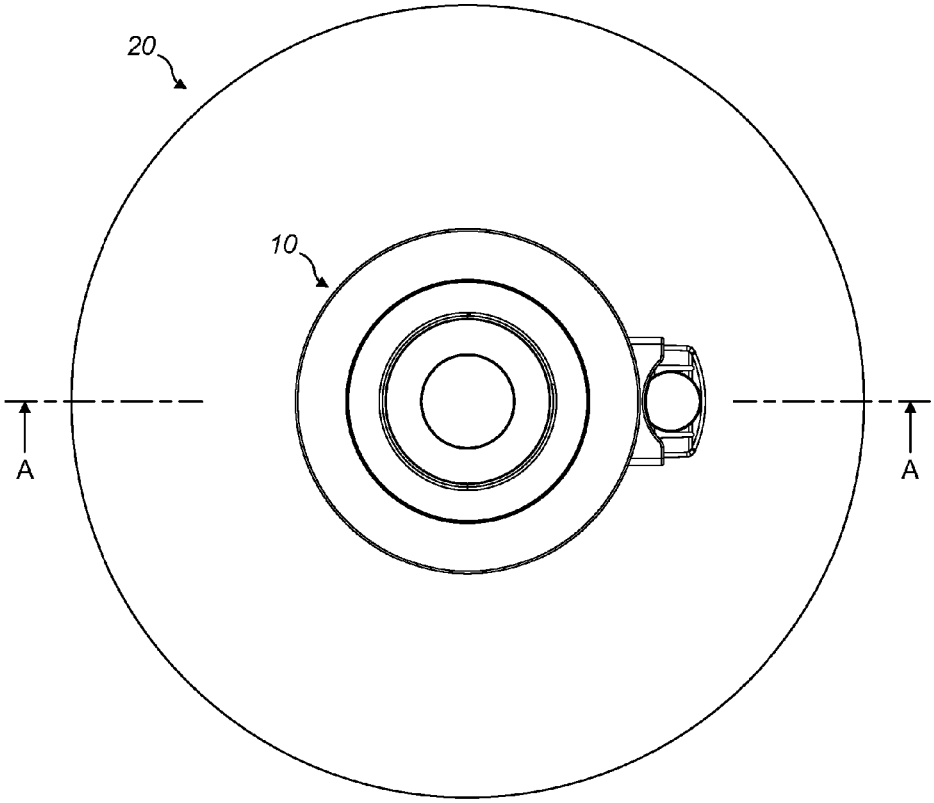
FIG. 3 is a top plan view of the closure and keg of FIG. 2.

A closure 10 according to the first embodiment of the present invention will now be described in more detail with reference to FIGS. 1 to 11*b*. Referring firstly to FIGS. 1 to 3, the closure 10 comprises a barrier in the form of a rubber bung 1, a generally annular housing 2, a venting member in the form of a push button 3, an annular seal 4, a valve mechanism 5, a coil spring 6 and a basket 7.

The annular seal 4, the valve mechanism 5 and the coil spring 6 share many features in common with the aforementioned previously-known keg closures. In particular, they allow movement of a valve element to open and close concentric flow paths to allow the keg 20 to be filled with beverage, and also allow dispensing of beverage from the keg 20.

For example, during dispensing, a dispense head is fitted to the closure 10 and operated to open the valve element of the valve mechanism 5. Accordingly, the concentrically-outermost flow path allows pressure to be introduced into a headspace 21 internal to the keg 20 thereby allowing a beverage such as beer to be dispensed under super-atmospheric pressure from the concentrically-innermost flow path which is in communication with a dip-tube 29.

It should be noted that FIG. 1 does not show the whole of the keg 20 and the dip-tube 29. However, it will be appreciated that the upper end of the dip-tube 29 connects to the underside of the valve mechanism 5 (as shown in FIGS. 4 and 5), and the lower, open end of the dip-tube 29 is positioned at a lowermost position within the keg 20. This ensures that substantially all the beverage within the keg 20 can be drained from it. Accordingly, the closure 10 together with the dip-tube 29 defines a fluid flow path that extends between the outlet and a lowermost position of the keg.

For the avoidance of doubt, the keg 20, the dip-tube 29 and certain features of the closure are similar to those described in International Publication Number WO2007/064277 the contents of which are hereby incorporated by reference.

After dispensing of beverage, when a dispense head is removed from the closure 10, the valve mechanism 5 automatically closes the valve element. Accordingly, this super-atmospheric pressure remains inside the keg 20. Some of the remaining components of the closure 10, in particular the bung 1 and the push button 3, cooperate to define a safety mechanism that allows this pressure to be vented to allow safe disposal of the keg 20 after use as will be described in greater detail below.

The closure 10 and keg 20 have complementary engagement structures which allow the closure 10 to be push-fit onto the keg 20. In the present embodiment, the complementary engagement structures include a circumferential flange 28 on the neck 8 of the keg 20, and a complementary snap-ring 18 on the closure. During push-fitting of the closure 10 to the keg 20, the snap-ring 18 is arranged to snap-fit into place underneath the circumferential flange 28. Advantageously, in contrast with other screw-thread arrangements, such a snap-fit connection between the closure 10 and the keg 20 can more easily be automated and also provides a more reliable and tamper-proof engagement between the closure 10 and keg 20.

FIG. 4 shows a sectional view of the closure 10 in an unvented configuration, the bung 1 being at a position sealing a venting hole 11 defined in the wall of the housing 2. The bung 1 is positioned adjacent to the push button 3. The push button 3 is slidable in a radially-inward direction towards the bung 1 along a channel 13 which is also defined in the sidewall of the housing 2. The bung 1 and the venting hole 11 are shaped to restrain the bung 1 against movement in an outward direction away from the interior of the closure 10. This is by virtue of an enlarged inwardly-directed head of the bung 1 and a slight relative tapering between the bung 1 and the venting hole 11.

FIG. 5 shows the same view as FIG. 4, but with the closure 10 in a vented configuration. As the closure 10 is switched from the unvented configuration of FIG. 4 to the vented configuration of FIG. 5, the push button 3 displaces the bung 1 from the venting hole 11. Specifically, a drive member in the form of a rod portion 16 of the button 3 extends through the venting hole 11 to drive the bung 1 in a radially-inward direction unsealing it from the venting hole 11. The bung 1 thereby detaches from the venting hole 11 defined in the housing 2 and falls into the basket 7.

As can be seen clearly in FIGS. 10 and 11, holes in the basket 7 are sized to ensure that the bung 1 cannot fall through them and into the keg. Thus, the basket 7 together with the other internal structures of the closure 10, define a retention portion in the form of a cage that retains the bung 1 to the closure, preventing the bung 1 from falling into the beverage, potentially spoiling it or introducing a choking hazard to a consumer of the beverage.

The opening of the venting hole 11 ensures a gas can flow along a gas vent path between the headspace 21 of the keg 20 and the environment external to the keg 20 and closure 10. Accordingly, if there is super-atmospheric gas remaining in the keg 20, this will be vented through the venting hole 11. Specifically, gas is able to pass from the headspace 21, via holes in the basket 7 into an annular chamber defined between the housing 2 and the valve mechanism 5 and through the venting hole 11 communicating with that chamber—the gas flowing around the outside of the rod portion 16.

Moreover, although the rod portion 16 is inserted into the venting hole 11, the rod portion 16 defines a conduit through which the gas being vented can flow. This can be more clearly seen in FIG. 11*b*. The rod portion 16 of the push button 3 has a frustoconical tip with an end-surface 16*a* which contacts with the bung 1 when the closure 10 is being switched from the unvented to the vented configuration. The rod portion 16 also comprises a pair of indents 16*b*. These, together with the taper of the frustoconical tip define said conduit.

It will be noted that the end-surface 16*a* which contacts with the bung 1 is far smaller than the region of the push button 3 that a user pushes. Accordingly, the manually-applied force of the user can be easily transferred to the bung 1 to dislodge it.

As the bung 1 falls away from the venting hole 11, the effect of pressing the push button 3 to depressurise the keg 20 is permanent—i.e. whilst the closure is fitted to the keg, it is not possible to repressurise the keg 20 once the push button 3 has been pressed. Thus, the closure 10 is configured to switch irreversibly from an unvented configuration to a vented configuration.

In view of this, it is desirable to prevent accidental or premature pressing of the button 3. To this end, the push button 3 comprises latch members in the form of a pair of jaws 32 integrally-formed with the push button 3.

Referring to FIG. 2, the jaws 32 protrude vertically beyond the extent of the opening defined by channel 13 to block the movement of the push button 3 radially-inward towards the bung 1. The jaws 32 are disposed above and below the main body of push button 3, and are able to flex resiliently relative to the rest of the push button 3 to which they are attached. To enable the push button 3 to slide into the channel to vent the keg 20, a user must first squeeze the jaws 32 together to deflect them inward so they no longer extend beyond opening of the channel 13; only then can the push button 3 be driven into the channel 13 to displace the bung 1.

Referring back to FIG. 1, the push button 3 also comprises a resilient pair of prongs 33 that have ratchet formations 33*a* at their tips. The ratchet formations 33*a* of the prongs 33 cooperate with a first outward pair of openings 14 and a second inward pair of openings 15 defined in the channel 13 to ratchet the push button 3 into the channel 13. In particular, during assembly, but before venting, the push button 3 is slid into the channel 13 so that ratchet formations of the prongs 33 lock into the first pair of openings 14. This retains the push button 3 in the channel 13, preventing it from moving radially outward from the channel 13 and so possibly falling out of the channel 13 during transit. As mentioned, and at the same time, the jaws 32 prevent the push button 3 from moving radially further into the channel 13.

When moving the push button 3 inwardly to displace the bung 1 to switch the closure 10 from the unvented to the vented configuration, the ratchet formations 33*a* of the prongs 33 slide past the first pair of openings 14 and latch into the second pair of openings 15. The push button 3 thereby latches into a position where it is permanently recessed with the channel 13, providing a visual indication to a user that the closure 10 has been vented, and the keg 20 can safely be disposed. Furthermore, the user is provided with a tactile and audible cue that the closure 10 has been latched into the vented position when the prongs 33 spring out and their ratchet formations 33*a* click into place within the openings 14.

FIGS. 12 to 17*a* show a closure according to the second embodiment of the present invention, the main difference over the first embodiment being the shape of the push button 3. Here, the push button 3 has a chamfered profile, with a ramped upper surface. Unlike the first embodiment, the upper surface does not consist of a jaw; only the lower surface of the push button 3 supports a jaw 32*a*. This configuration reduces the profile of the closure 10 and simplifies its operation. Furthermore, the closure of the second embodiment allows one of the user's fingers to operate the jaw 32*a* on the lower surface of the push button 3 whilst an opposing finger on the ramped upper surface of the push button 3 simultaneously provides a reaction force to enable the jaw 32*a* to be squeezed upwardly while pushing the push button 3 in a radially-inward direction to vent the keg 20.

The invention claimed is:

1. A closure for a beverage keg, the closure comprising a housing defining:

an inlet for admitting a pressurised gas into a headspace of a beverage keg; and a venting hole separate from the inlet, the venting hole communicating with a gas vent path between the headspace of the keg and an exterior of the closure; the closure further comprising a barrier for sealing the venting hole;

wherein, when fitted to the keg, the closure is configured to be switchable from:

an unvented configuration in which the barrier seals the venting hole so that the closure is able to retain a pressurised gas within the keg; to a vented configuration in which the venting hole is no longer sealed by the barrier so that a pressurised gas in the headspace of the keg can escape along the gas vent path via the venting hole to the exterior of the closure; thereby permanently depressurising the keg, wherein the barrier is engaged to the housing defining the venting hole when the closure is in the unvented configuration, and the barrier is arranged to be dislodged from its engagement with the housing defining the venting hole so as to switch the closure to the vented configuration.

2. The closure of claim 1, wherein the barrier is a discrete member which, when dislodged, separates from the housing defining the venting hole, and further comprises a retention portion for retaining the barrier to the closure when the closure is in the vented configuration, and the barrier is unsealed from the venting hole.

3. The closure of claim 1, wherein at least one of the barrier and housing defining the venting hole are shaped to restrain the barrier against movement in an outward direction towards the exterior of the closure.

4. The closure of claim 3, wherein the barrier and housing defining the venting hole are tapered relative to one another so as to restrain the barrier against movement in the outward direction toward the exterior of the closure.

5. The closure of claim 1, further comprising a venting member arranged to act on the barrier to dislodge the barrier from the venting hole thereby to switch the closure from the unvented to the vented configuration.

6. The closure of claim 5, wherein at least a portion of the venting member is arranged to fit within the venting hole, and wherein the portion of the venting member that is arranged to fit within the venting hole defines a conduit shaped and arranged to permit gas released during depressurisation of the keg to flow through the venting hole.

7. The closure of claim 5, wherein the venting member is arranged to drive the barrier in an inward direction away from the exterior of the closure, and in towards the gas vent path.

8. The closure of claim 5, wherein the venting member comprises a drive member for transmitting a manually-applied force to the barrier.

9. The closure of claim 5 further comprising at least one latch member arranged to be movable between:

a latched position at which the latch member blocks movement of the venting member preventing the venting member from acting on the barrier; and an unlatched position at which the venting member is free to move to a position at which the venting member can act on the barrier to unseal the venting hole.

10. The closure of claim 9, wherein the at least one latch member is biased towards the latched position.

11. The closure of claim 1, further comprising at least one ratchet formation that locks the venting member at a position at which the venting member has acted on the barrier to unseal it from the venting hole.

12. The closure of claim 11, wherein the at least one ratchet formation is integrally-formed with the venting member.

13. The closure of claim 1, further comprising a valve element for opening and closing the inlet.

14. The closure of claim 13, wherein the first valve element is biased towards a closed position.

15. The closure of claim 13, further comprising an outlet through which a beverage may be extracted from the keg to which the closure is fitted.

16. The closure of claim 15, wherein the valve element is for opening and closing the outlet of the closure.

17. The closure of claim 15, further comprising a dip-tube positioned so that when the closure is fitted to a keg, a fluid flow path extends between the outlet of the closure and an internal base region of the keg.

18. The closure of claim 15, wherein the closure is arranged to receive a pressurised gas via the inlet and to dispense beverage from a keg to which the closure is fitted via the outlet when in the unvented configuration.

19. A keg, supplied or fitted with a closure of claim 1.

20. A method of controlling the pressurisation of a beverage keg, the method comprising:

fitting a closure to the keg, the closure defining a venting hole communicating with a gas vent path between a headspace of the keg and an exterior of the closure, the closure being provided with a barrier to seal the venting hole so as to retain a pressurised gas within the keg; and dislodging the barrier from the venting hole to permanently depressurise the keg.

21. A method of improving the safety of a draught beverage keg comprising:

fitting a closure to the keg, the closure comprising a venting hole and being in an unvented configuration in which the venting hole is sealed by a barrier and thereby the closure is able to retain a pressurised gas within the keg;

filling the keg with beverage to be dispensed on draught;

transporting the filled keg to a dispensing location;

injecting a pressured gas into the keg to dispense beverage from it; and after dispensing of beverage:

permanently depressurising the keg by switching the closure from the unvented configuration to a vented configuration by dislodging the barrier from the venting hole.

* * * * *